United States Patent [19]

Properzi

[11] 4,300,618

[45] Nov. 17, 1981

[54] FIXABLE WIDTH CASTING WHEEL

[76] Inventor: Giulio Properzi, Via Pietro Cossa, 1, Milano, Italy

[21] Appl. No.: 1,129

[22] Filed: Dec. 19, 1978

[30] Foreign Application Priority Data

Jan. 10, 1978 [IT] Italy ..... 191204 A/78

[51] Int. Cl.[3] ..... B22D 11/06

[52] U.S. Cl. ..... 164/433; 164/436

[58] Field of Search ..... 164/87, 433, 434, 436, 164/414, 342; 249/102, 155; 425/195; 74/230.16, 230.17 R, 230.17 A

[56] References Cited

U.S. PATENT DOCUMENTS

| | | | |
|---|---|---|---|
| 2,299,921 | 10/1942 | Myers | 74/230.17 A |
| 2,440,321 | 4/1948 | Bacon | 425/195 X |
| 3,180,163 | 4/1965 | Robertson | 74/230.17 A |
| 3,626,479 | 12/1971 | Properzi | 164/414 |
| 3,735,801 | 5/1973 | Burkhardt | 164/436 |
| 4,122,889 | 10/1978 | Richards | 164/433 X |

FOREIGN PATENT DOCUMENTS

| | | | |
|---|---|---|---|
| 662609 | 4/1965 | Belgium | 164/434 |
| 1364717 | 5/1964 | France | 164/433 |

*Primary Examiner*—Robert D. Baldwin

*Attorney, Agent, or Firm*—Guido Modiano; Albert Josif

[57] ABSTRACT

A casting wheel for a continuous casting machine of the wheel-and-belt type is provided with at least one annular member defining one of the lateral walls of the casting groove. The annular member is secured to one of the support flanges of the casting ring preferably by interposition of a gauged annular distance piece, this piece having each time an axial length such as to obtain, when added to the annular member, the desired groove width. The casting wheel is particularly suitable for casting aluminum strips. Substitution of a gauged annular distance piece with another having a different axial length allows the width of the cast strips to be varied without substituting the whole casting ring.

3 Claims, 3 Drawing Figures

FIXABLE WIDTH CASTING WHEEL

BACKGROUND OF THE INVENTION

This invention relates to a casting wheel for a continuous casting machine, particularly for casting aluminum strips.

A casting wheel, for example as described in U.S. Pat. No. 3,583,474, consists generally of two spaced-apart facing flanges, of which at least one is rotated by the drive means for the casting machine, a casting ring supported by said flanges and having a peripheral groove, and a metal belt which covers the casting ring over a certain arc in order to define therewith a mold in which the molten metal is cast. The metal is gradually cooled during rotation of the wheel, and leaves it substantially solidified in the form of a continuous bar.

One of the problems in this field is to adapt the machine to casting bars, ingots or strips of different section. This is particularly so in the case of strips, i.e. continuous bars with one of the transverse dimensions much greater than the other transverse dimension, and which are subsequently rolled into sheets. Aluminum strip is one example of this.

Generally the casting ring has to be replaced each time in order to cast strips of different width, so leading to a considerable time wastage and loss of production. To do this, the casting wheel has to be stopped each time, one of the support flanges has to be dismantled, the ring has to be removed to replace it with the required ring, and the flange then reassembled to recommence production. To this cost disadvantage, there is added the need to stock a large number of different sized rings to satisfy any specific production requirements, so further increasing both maintenance and production costs.

SUMMARY OF THE INVENTION

The object of the present invention is to allow strips of different width to be cast without the need to replace the casting ring each time, and without having to stock rings of different cross-section. The object is therefore to provide a casting wheel which makes it possible practically, rationally and above all economically, to adapt the machine to producing strips of different width, in particular aluminum strips.

This object is attained by a casting wheel of the aforesaid type, comprising two facing spaced-apart support flanges of which at least one is a drive flange, and a casting ring supported by said flanges and having a peripheral groove closed over a certain arc by a metal belt to define a mold for receiving molten metal, wherein at least one of the lateral walls of the casting ring defining the mold is constituted by at least one annular member separate from the ring structure and fixable concentrically to the ring structure in an axial position such as to define a mold having a predetermined width.

In a casting wheel of this construction, it is no longer necessary to replace the casting ring each time a strip of different width is to be produced, it being merely necessary to dispose and fix one of said annular members in such a manner as to make the width of the mold correspond to the required strip width. It is therefore no longer necessary to stock a large number of casting rings of different section, but merely a single ring and a certain number of said annular members which, because of their limited size, can in any case be stored in a considerably smaller space, in addition to being of lower cost than a complete ring. The actual replacement of said annular members is also less of a burden because of their light weight relative to the weight of a complete ring, and is also more rapid, so leading to cost advantages in operating the casting machine.

Said annular members can each advantageously consist of a basic member of constant size for each width of cast strip, fixable in the required position by way of at least one annular gauged distance piece having an axial dimension which is suitable for obtaining the width of the respective cast strip, the distance piece being fixed to one of the support flanges.

In this manner, the material which has to be replaced after a certain time due to deterioration caused by thermal stress is limited to only the basic members, which are of small size, so saving the distance pieces which can be used for a longer time.

BRIEF DESCRIPTION OF THE DRAWING

Further characteristics and advantages of the invention will be more apparent from the detailed description given hereinafter with reference to the accompanying drawing, in which.

DESCRIPTION OF A PREFERRED EMBODIMENT

Figure 1:
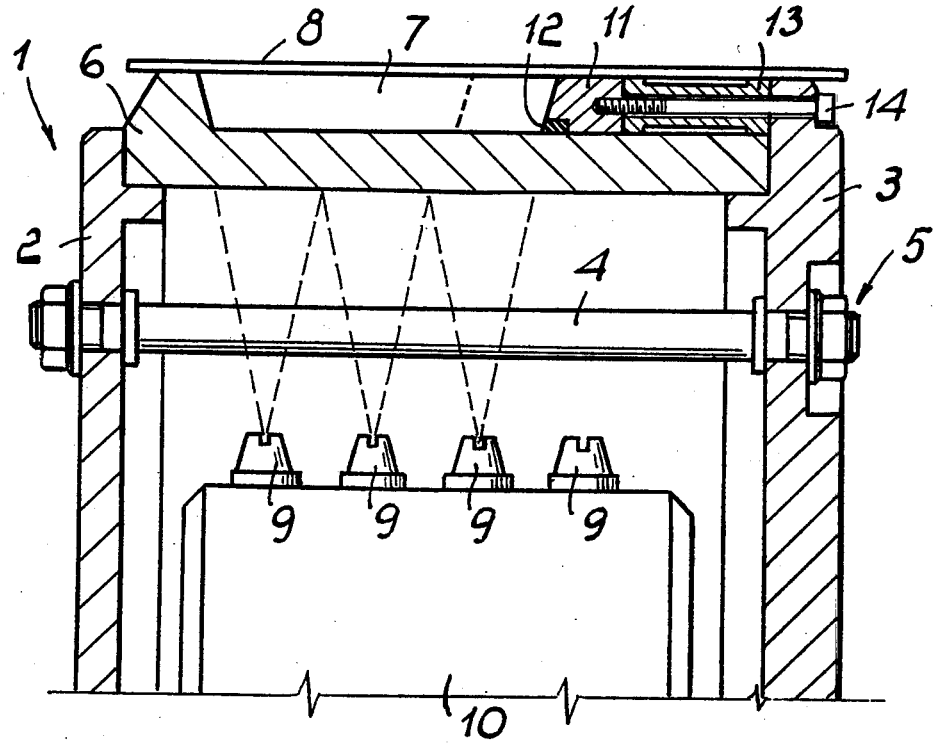
FIG. 1 is a partial axial section through a casting wheel according to the invention.

FIG. 1 shows a casting wheel 1 comprising two spaced-apart facing support flanges 2, 3, at least one of which is directly rotated by the casting machine drive means, not shown. The flanges 2, 3 are connected together in known manner by tie bars 4 and tightening nuts 5 distributed along the flange periphery. Between them, they support a casting ring 6, having a peripheral groove for casting strip, for example aluminum strip. A metal belt 8 covers the groove over a certain arc in known manner, to define a mold 7 for casting the molten metal.

Cooling nozzles 9 are arranged inside the casting ring 6, and are connected to a fixed annular manifold 10, through which they are supplied with the cooling liquid.

According to the invention, at least one of the lateral walls of the casting ring 6 which define the mold 7 is defined by at least one annular peripheral member 11 separate from the structure of the casting ring 6, and fixable concentrically to the structure of the casting ring 6 in an axial position such as to define a mold 7 of the required axial width.

Figure 2:
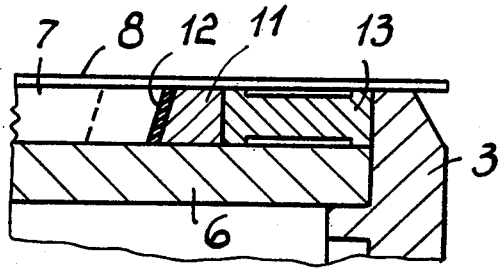
FIG. 2 is a detail of a casting wheel according to the invention, in which an annular member is used which is configured differently from that used in the casting wheel of FIG. 1.

The annular member 11 has a radial dimension equal to that of the mold 7. That face of the annular member 11 which faces the mold 7 is inclined symmetrically to the opposite face of the casting ring 6. At least in that part adjacent to the base of the casting ring 6, the annular member 11 comprises on its inclined face a gasket 12 of special material, the purpose of which is to prevent infiltration of liquid metal between the member itself and the base of the casting ring 6, given the machining tolerances necessary for mechanically connecting the casting ring 6 to the annular member 11. The gasket 12 can be advantageously cemented to the member 11, whether it is provided only at the internal corner of the member 11 as shown in FIG. 1, or whether it extends over the entire height of the member 11 as shown in FIG. 2. It can also be fixed in other ways, for example by screws. As the belt 8 is kept pressed against the ring and member 11, it being stretched around the casting wheel, and as the member 11 tends to expand radially outwards during casting because of its contact with the hot metal, a seal between the belt 8 and member 11 is generally formed even without gaskets between these two members.

As shown in FIGS. 1 and 2, the casting ring 6 preferably lacks one of the lateral walls, and the annular member 11 which acts as the lateral wall of the mold 7 preferably extends over only part of the distance by which the width of the mold 7 has to be reduced in order to obtain the required strip width instead of extending over all of it, the remaining part being occupied by a gauged distance piece 13 concentric with the casting ring 6 and member 11. The gauged distance piece 13 and member 11 are arranged adjacent to each other and fixed to the peripheral portion of the flange 3 which projects beyond the base of the mold 7, fixing being obtained for example by screws 14 which engage externally the flange 3 and are screwed into the member 11. The distance piece is fixed at several points along the periphery of the flange, which also acts as a support for the metal belt 8.

The distance piece 13 has a height, at least at its ends, equal to that of the member 11, and has an axial dimension suitable for the respective strip width to be produced. It is apparent that by fitting each time a distance piece 13 having a different axial dimension while keeping the same basic member 11, a mold 7 is obtained which each time has a different width, as indicated by the dashed line in FIGS. 1 and 2. Consequently, it is only necessary to replace the gauged distance piece 13 to adapt the machine for casting strip of different width.

Advantageously, the cooling nozzles 9 disposed around the manifold 10 in parallel rows each comprising three, four or more nozzles, can be controlled individually or in groups, so as to inactivate the nozzles acting on those parts of the ring not concerned with the casting when the strip to be produced is of small size, as indicated in FIG. 1 for the right hand nozzle.

From the description, it is apparent that the replacement of the gauged distance piece 13 for adapting the machine to casting strip of different width is extremely simple and economical, it being necessary only to remove the flange 3 and withdraw the distance piece 13 without having to remove the casting ring 6, as is necessary in conventional machines. It will also be apparent that the small weight and size of the member to be removed makes the operation much more rapid and less burdensome than is presently the case.

Figure 3:
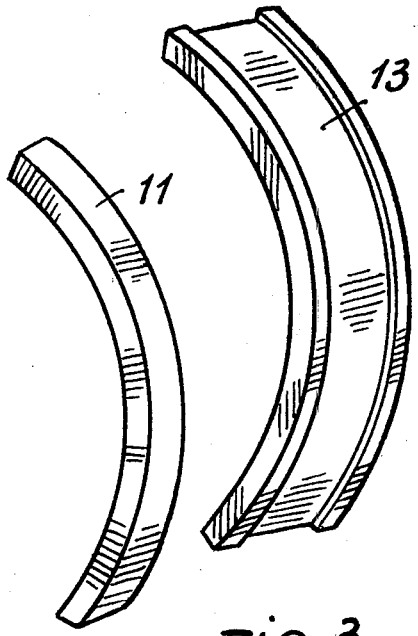
FIG. 3 is a perspective detailed view of an annular member and an annular gauged distance piece.

The annular member 11 and/or the gauged distance piece 13 can also be in the form of several single arcuate members shown in FIG. 3, which are rigidly connected to each other to define ring members which are continuous right around the casting wheel once they have been mounted on it. In this case, they can be mounted on the casting wheel without removing any support flange, given that they can be fitted to the casting ring in a radial direction. This operation could be carried out in succession in the region where the metal belt does not cover the wheel, thus making it unnecessary even to remove the metal belt.

I claim:

1. A casting wheel for a continuous casting machine, particularly for casting aluminum strips, comprising two facing spaced-apart support flanges of which at least one is a drive flange, a casting ring supported by said flanges and having a peripheral groove, said casting ring having a lateral wall defining one side of a mold, at least one annular member fixable concentrically to said casting ring within said groove having a lateral wall defining an opposed side of said mold, means to removably fix said at least one annular member in an axial position such as to form a mold having a predetermined axial width, and a metal belt closing said groove over an arc of said casting ring to complete said mold for receiving molten metal, wherein said at least one annular member fixable to said casting ring within said groove comprises at least one annular basic member and at least one annular gauged distance piece arranged adjacent each other, said at least one distance piece being fixed to one of said support flanges.

2. A casting wheel as claimed in claim 1, wherein said at least one annular basic member and said at least one gauged distance piece each comprise a plurality of arcuate members which can be connected together to define a continuous ring member.

3. A casting wheel as claimed in claim 1, wherein said one of said support flanges has a peripheral portion extending adjacent to said casting ring groove and said at least one annular basic member and said at least one gauged distance piece are fixed to said peripheral portion.

* * * * *